US006273362B1

(12) United States Patent
Fisch et al.

(10) Patent No.: US 6,273,362 B1
(45) Date of Patent: Aug. 14, 2001

(54) COMPOSITE WINDOW TRANSPARENT TO ELECTROMAGNETIC RADIATION FOR USE IN SUPERSONIC AND HYPERSONIC TARGET-TRACKING MISSILES

(75) Inventors: Peter Gerd Fisch, Überlingen; Siegfried Bosch, Salem, both of (DE)

(73) Assignee: Bodenseewerk Geratetechnik GmbH (DE)

( * ) Notice: Subject to any disclaimer, the term of this patent is extended or adjusted under 35 U.S.C. 154(b) by 0 days.

(21) Appl. No.: 09/360,758

(22) Filed: Jul. 26, 1999

(30) Foreign Application Priority Data

Jul. 28, 1998 (DE) ..... 198 33 884

(51) Int. Cl.[7] ..... F41G 7/00; F42B 15/01

(52) U.S. Cl. ..... 244/3.16; 244/3.19; 343/705; 343/872

(58) Field of Search ..... 244/117 R, 119, 244/121, 3, 16, 3.19; 343/700 R, 705, 708, 872, 873; 250/515.1, 517.1; 428/116, 212–218, 911, 313.3–313.9; 264/257

(56) References Cited

U.S. PATENT DOCUMENTS 4,613,540 * 9/1986 Traut et al. ..... 428/212
5,182,155 * 1/1993 Roe ..... 428/116
5,457,471 * 10/1995 Epperson, Jr. ..... 343/872
5,707,723 * 1/1998 Harrison et al. ..... 428/313.3
5,849,234 * 12/1998 Harrison et al. ..... 264/257

* cited by examiner

*Primary Examiner*—Bernarr E. Gregory
(74) *Attorney, Agent, or Firm*—Mallinckrodt & Mallinckrodt; Robert R. Mallinckrodt

(57) ABSTRACT

The invention relates to a window for use in a supersonic or hypersonic target-tracking missile, the window being transparent to electromagnetic radiation. The window consist of several window layers which support each other and which are commonly supported, wherein the materials, the thickness and the arrangement of said window layers are selected to reduce mechanical stresses due to temperature during supersonic or hypersonic flight as compared to a continuously homogeneous window. In one embodiment the window layers are fixedly interconnected with their surfaces facing each other and consist of materials having different thermal coefficients of dilatation such that, with the temperature gradient occurring in said window during supersonic or hypersonic flight, substantially identical thermal dilatations are achieved in each of said window layers. A further measure is to provide a slip or lubricant layer between the window layers, which slip or lubricant layer allows a relative motion of the window layers parallel to the surfaces facing each other, thereby reducing transmission of stresses between the window layers.

9 Claims, 2 Drawing Sheets

COMPOSITE WINDOW TRANSPARENT TO ELECTROMAGNETIC RADIATION FOR USE IN SUPERSONIC AND HYPERSONIC TARGET-TRACKING MISSILES

BACKGROUND OF THE INVENTION

This invention relates to a window for use in a supersonic or hypersonic target-tracking missile, the window being transparent to electromagnetic radiation.

Supersonic and hypersonic target-tracking missiles are provided with a seeker head having a seeker responding to electromagnetic radiation. The seeker head detects e.g. the infrared radiation from a target object. When the missile is flying at supersonic or hypersonic speed, the structure of the missile is heated up very strongly due to aerokinetic heating-up. High mechanical and thermal loads occur in the missile and the seeker head. Due to the temperature gradients caused thereby, internal stresses are generated to an extent near the breaking point of the material. Furthermore, extremely high impact pressures act on the structure at high air speeds.

The seeker is protected by a window, which is transparent to the relevant electromagnetic radiation.

There are only very few materials which are transparent to infrared radiation and have mechanical properties sufficient for supersonic and hypersonic speeds. Known electromagnetically transparent windows for supersonic and hypersonic target-tracking missiles are made either of magnesium fluoride, zinc sulfide, sapphire or diamond. Furthermore, depending on the requirement, the windows can have different shapes and thickness. For example, it is tried to increase the thickness of the window in order to counteract the thermal loads by increasing the heat capacity.

Windows made of magnesium fluoride or zinc sulfide have a relatively low thermal conductivity and, thus, they are heated up very much during the flying phase, which lead to melting of the outer surface of the window. Furthermore, the seeker can become "blind" due to the self-emission of the window.

When the windows are made of infrared-transparent materials sensitive to brittle fracture, a larger thickness of the window is favorable for taking up the pressure load. On the other hand, thinner windows have favorable properties with regard to thermal shock loads. There exist an optimum window thickness, for which the stresses of the window caused by impact pressure and temperature are minimal.

All known windows transparent to electromagnetic radiation and used in supersonic and hypersonic target-tracking missiles have the disadvantage that they resist the thermal and mechanical loads during the flying phase just for a short time of 1–2 seconds. Normally, however, the actual time of flight is much longer. Up to now this problem is solved in that the window is protected by a solid protective covering during the first flying phase. Thus, during this flying phase, the seeker is covered and target-tracking is not possible. Not until the final flying phase, when the missile already is close to the target, the protective covering is thrown off, which enables the actual target-tracking by the seeker. Such a protective covering is described in German Patent Application No. 37 15 085. Apart from the limitation of the time of target-tracking, the use of such a protective covering is of rather complex design.

European Patent Application No. 0 599 035 discloses a connecting arrangement for connecting a dome, which covers a seeker head and is made of relatively brittle infrared-transparent material, to the structure of a missile. This connecting arrangement comprises a retaining ring extending over the rim of the dome, positively holding the dome and connected to the structure of the missile. The connection is effected without material interconnection between dome and retaining ring. A groove is provided along the rim of the dome under the retaining ring. A flexible sealing means is provided in this groove for sealing between the retaining ring and the dome.

SUMMARY OF THE INVENTION

One object of the present invention is to improve a window of the above mentioned type, such that its resistance to the loads occurring during the flying phase of the missile is improved.

According to the invention this object is achieved in that the window has several window layers which support each other and which are commonly supported, wherein the material choice, the thickness and the arrangement of the window reduce mechanical stresses due to temperature during supersonic or hypersonic flight as compared to a continuously homogeneous window.

The invention is based on the following considerations: The window has to have a certain thickness in order to resist the considerable mechanical loads. A temperature gradient appears across this total thickness of the window. The window will be very hot at the outer surface and in the outer layers. The layers of the window located further inward are, at first, less heated up. In a homogenous window this would lead to thermally induced mechanical loads: The thermal dilatation is larger in the outer layers than in the inner layers. The stresses due to this fact can be reduced by using a multilayer window.

The arrangement can be such that the layers of the window are fixedly interconnected with their surfaces e.g. by being "optically interconnected" such that an "optical contact" is achieved. The expressions "optically interconnected" and "optical contact" means that the two surfaces are plain to such an extent, that, when brought into contact with each other, they adhere to each other due to intermolecular forces acting between the two surfaces. This ensures a good heat transmission between the layers and the temperature gradient is kept as small as possible. In order to prevent stresses between the layers due to the unavoidable temperature gradient, then, with respect to their coefficients of dilatation, the materials of the layers have to be chosen such that the dilatations of the layers having different temperatures are as similar as possible. The hot layers near the outer surface have to have a lower coefficient of dilatation than the colder inner layers.

However, the arrangement can also consist of providing a slip or lubricant layer between the window layers, which slip or lubricant layer allows a relative motion of the window layers parallel to their surfaces facing each other, such that the transmission of stresses between the window layers is reduced.

The durability of a window according to the invention can be 10 seconds and more. Typical times of mission of a supersonic or hypersonic target-tracking missile are in the range of 3–8 seconds. Thus, it is not necessary to provide particular protective coverings which protect the window during certain flight phases.

Further objects and features of the invention will be apparent to a person skilled in the art from the following specification of a preferred embodiment when read in conjunction with the appended claims.

BRIEF DESCRIPTION OF THE DRAWING

The invention and its mode of operation will be more clearly understood from the following detailed description when read with the appended drawing in which.

DESCRIPTION OF THE PREFERRED EMBODIMENT

Figure 1:
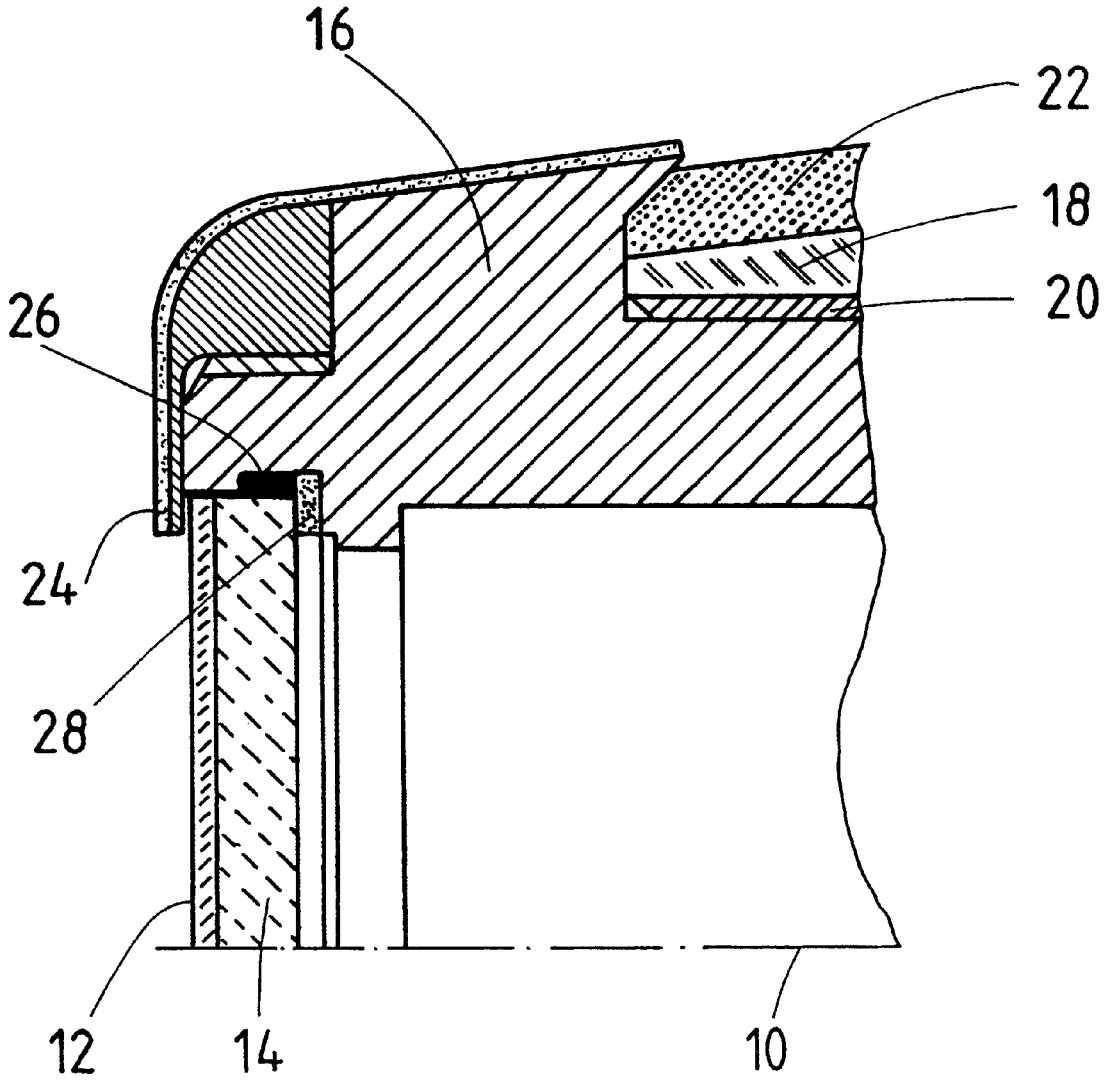
FIG. 1 is a schematic sectional illustration and shows the front part of a seeker head of a target-tracking missile.

Referring now to FIG. 1, there is shown a window, which is used in a seeker head of a supersonic or hypersonic target-tracking missile. The illustrated part of the seeker head is rotationally symmetrical. The axis of rotation is designated by reference numeral 10. The direction of flight of the missile is to the left in FIG. 1.

The window consists of a front window layer 12 and a back window layer 14, which are optically interconnected. The front window layer 12 consists of sapphire and is relatively thin. The back window layer 14 consists of magnesium fluoride and is relatively thick. The window is located in a mounting 16. The mounting 16 is connected to the structure 18 of the missile. An insulation layer 20 made of silicone is located between the mounting 16 and the structure 18. Furthermore, the mounting 16 is insulated from the structure 18 by an ablation layer 22. The mounting 16 extends with an rim 24 over the window. In the illustrated embodiment, the window is sealed relatively to the structure through a first and a second seal 26 and 28, respectively. However, it is also possible to use just one seal. The seals are subject to high temperatures, such that they partly can be decomposed during the flying phase and act as ablation layer. However, such high-temperature seals are known per se and, thus, are not described in detail herein.

Figure 2:
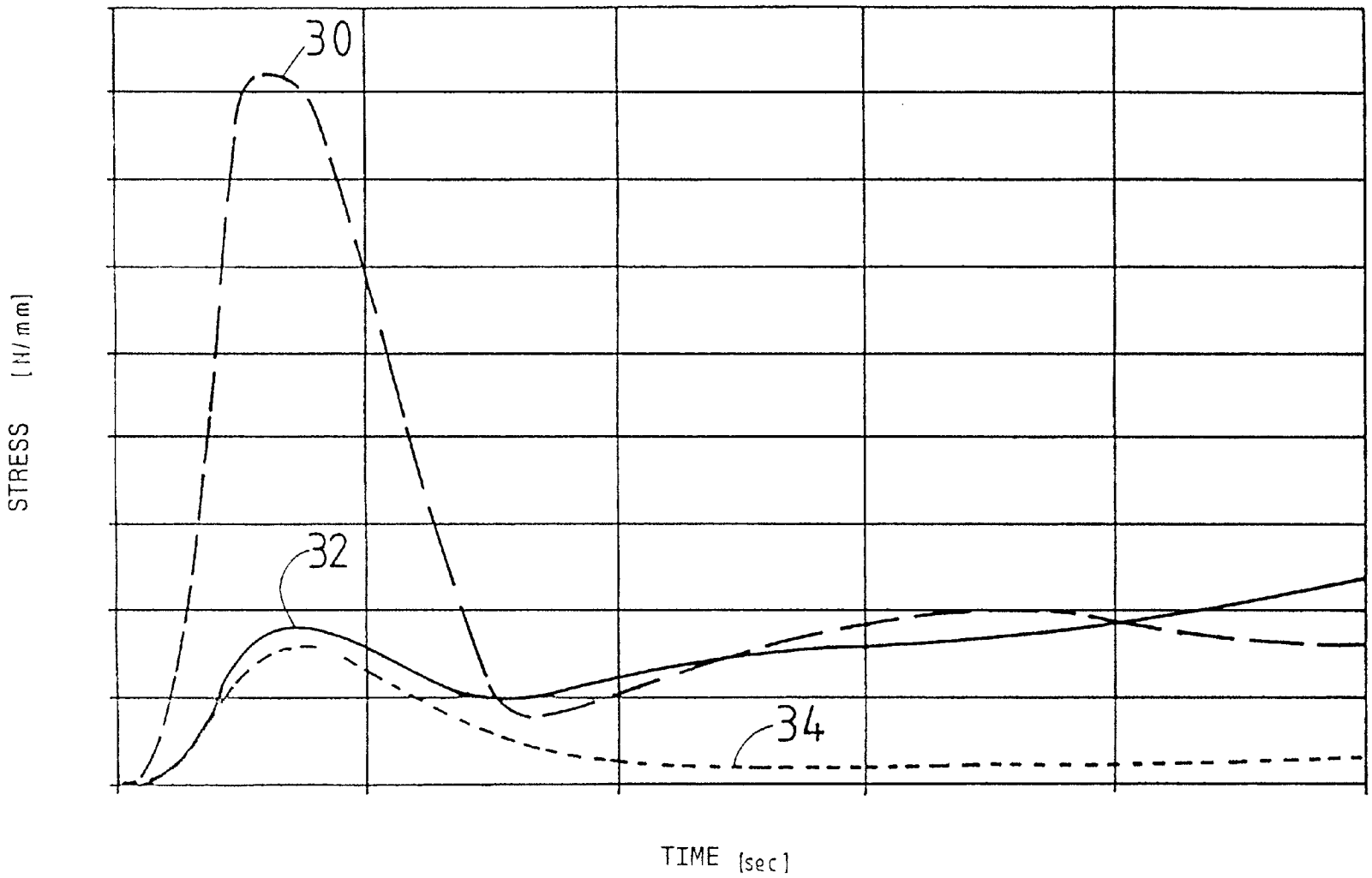
FIG. 2 shows the progression of the stresses appearing during the flying phase in three differently designed windows.

With reference to FIG. 2, there is shown the maximum stress as a function of time of flight appearing in three differently designed windows. The graphs are computer simulated. At the end of the acceleration phase, a very high impact pressure acts on the window, which is reduced again after the acceleration phase. The temperature load of the window increases over and above the acceleration phase. The graph 30 shows the basic progression of the stresses appearing in a conventional one-layer window. The graph 32 shows the progression of the stresses appearing in a window having two layers, which are optically interconnected at a temperature of 320° C. The graph 34 shows the progression of the stresses appearing in a window having two layers, between which a stress separation layer is located.

In the conventional window (graph 30) the stress increases during the acceleration phase due to the high impact pressure and the thermal shock and reaches a critical maximum after a short time. The known materials cannot resist such stresses.

The graph 32 shows that the stress in a window having two window layers optically interconnected and made of different materials at first increases to a moderate maximum, then decreases again and later increases again. All in all, the stress progression is clearly below the progression in a one-layer homogenous window. Due to the fact that the window layers have different coefficients of thermal dilatation, the high temperature causes a transverse strain between the window layers. The optical connection is made in such a manner, that thermally caused transverse strains between the two window layers is very small at the moment when the stress caused by the impact pressure is highest.

The graph 34 shows that the stress in a window having two window layers separated from each other by a slip or lubricant layer, e.g. an oil or grease layer, at first increases to a moderate maximum. Then the stress decreases again. The slip or lubricant layer causes the window layers to slide on each other when they are differently thermally expanded. Thus, no transverse strain can arise between the window layers. Thus, the high temperatures during the flight do not have any great influence on the stress appearing in the window.

We claim:

1. A window for use in a supersonic or hypersonic target-tracking missile, said window being transparent to electromagnetic radiation in a desired frequency range, comprising, a plurality of window layers which support each other and which are commonly supported, each of said window layers having a surface facing a surface of another of said window layers; said window layers being fixedly interconnected with said surfaces; and said window layers consisting of materials having different thermal coefficients of dilation, such that, with the temperature gradient appearing in said window during supersonic or hypersonic flight resulting in different temperatures for different layers, substantially identical thermal dilatations are achieved in each of said different temperature window layers to reduce mechanical stresses due to temperature during supersonic or hypersonic flight as compared to a continuously homogeneous window.

2. The window of claim 1, further comprising heat transmission means between said window layers for achieving a desired heat transmission between said window layers.

3. The window of claim 2, wherein said window layers are optically interconnected.

4. The window of claim 1, wherein the thermal coefficients of dilatation of outer layers are lower than those of inner layers.

5. The window of claim 1, wherein the plurality of layers is two layers, a relatively thin sapphire outer layer and a relatively thick magnesium fluoride inner layer.

6. The window of claim 1, wherein the thermal coefficients of dilatation of the outer layers are lower than those of the inner layers.

7. A window for use in a supersonic or hypersonic target-tracking missile, said window being transparent to electromagnetic radiation in a desired frequency range, comprising, a plurality of window layers which support each other and which are commonly supported, a slip or lubricant layer between said window layers, said slip or lubricant layer allowing relative motion of said window layers parallel to one other, thereby reducing transmission of stresses between said window layers to reduce mechanical stresses due to temperature during supersonic or hypersonic flight as compared to a continuously homogeneous window.

8. The window of claim 7, wherein the slip or lubricant layer is an oil.

9. The window of claim 7, wherein the slip or lubricant layer is a grease.

* * * * *